US008248265B2

(12) United States Patent
Jones

(10) Patent No.: US 8,248,265 B2
(45) Date of Patent: Aug. 21, 2012

(54) VEHICLE CONSOLE DISPLAY BUTTONS AND VEHICLE CONSOLES INCORPORATING THE SAME

(75) Inventor: Earnee Yasha Jones, Ypsilanti, MI (US)

(73) Assignee: Toyota Motor Engineering & Manufacturing North America, Inc., Erlanger, KY (US)

( * ) Notice: Subject to any disclaimer, the term of this patent is extended or adjusted under 35 U.S.C. 154(b) by 421 days.

(21) Appl. No.: 12/561,399

(22) Filed: Sep. 17, 2009

(65) Prior Publication Data

US 2011/0063123 A1 Mar. 17, 2011

(51) Int. Cl.
*G08B 5/00* (2006.01)

(52) U.S. Cl. ..... 340/815.4; 340/427; 340/468; 340/475; 362/26; 362/27; 362/29; 362/612; 362/634; 348/742; 348/744; 348/760

(58) Field of Classification Search ..... 340/815.4, 340/427, 468, 475; 362/26, 27, 29, 612, 362/634; 348/742, 744, 760
See application file for complete search history.

(56) References Cited

U.S. PATENT DOCUMENTS

| | | | | |
|---|---|---|---|---|
| 4,688,156 | A * | 8/1987 | Suzuki et al. | 362/354 |
| 4,758,701 | A * | 7/1988 | Nagel | 200/314 |
| 4,811,179 | A * | 3/1989 | Komatsu et al. | 362/256 |
| 5,036,440 | A | 7/1991 | Takii et al. | |
| 5,477,024 | A | 12/1995 | Share et al. | |
| 5,570,114 | A | 10/1996 | Fowler | |
| 6,179,430 | B1 | 1/2001 | LeDu | |
| 6,849,226 | B2 | 2/2005 | Ardrey et al. | |
| 7,073,916 | B2 | 7/2006 | Yin et al. | |
| 7,207,686 | B2 | 4/2007 | Schmidt et al. | |
| 7,252,400 | B2 | 8/2007 | Clugston et al. | |
| 7,350,954 | B2 | 4/2008 | Snider et al. | |
| 2003/0116415 | A1 | 6/2003 | Ardrey et al. | |
| 2007/0025096 | A1 | 2/2007 | Snider et al. | |

* cited by examiner

*Primary Examiner* — Tai T Nguyen
(74) *Attorney, Agent, or Firm* — Dinsmore & Shohl, LLP

(57) ABSTRACT

Display buttons and vehicle consoles include etched lenses operable to diffract light provided by a light source within a vehicle console such that the light emitted from the display button diverges from the first pathway within the button housing into a secondary pathway outside of the display button.

10 Claims, 3 Drawing Sheets

VEHICLE CONSOLE DISPLAY BUTTONS AND VEHICLE CONSOLES INCORPORATING THE SAME

TECHNICAL FIELD

The present invention generally relates to vehicle consoles and, more specifically, to vehicle consoles having display buttons with etched lenses.

BACKGROUND

A vehicle often contains numerous passenger displays positioned about its interior for visual reference. For example, some vehicles have separate heating, ventilating and air-conditioning (HVAC) controls for front and rear passengers. These controls may comprise lights, buttons, switches or other components that illuminate when activated such that passengers can observe and select multiple vehicle functions in various lighting conditions. However, when passengers are positioned away from or at an angle to a display, it is often difficult to view the passenger displays.

Accordingly, a need exists for vehicle console display buttons with improved display capabilities.

SUMMARY

In one embodiment, a vehicle console includes a display button disposed within a housing of the vehicle console, the display button comprising an indicator component, a light source disposed within the vehicle console, and operable to emit light through the display button and at least one etched lens associated with the vehicle display button operable to diffract light provided by the light source such that the light emitted from the indicator component diverges from a first pathway to a second pathway.

In another embodiment, a display button a vehicle console includes a housing for directing transmittance of light from a light source, an indicator lens having an indicator component identifying vehicle functionality and an etched lens comprising an etched pattern, at least a portion of the etched lens being disposed within the display housing between the light source and the indicator lens, wherein the etched lens is operable to diffract light provided by the light source such that the light emitted from the indicator component diverges from the first pathway within the housing into multiple secondary pathways outside of the display button.

These and additional features provided by the embodiments of the present invention will be more fully understood in view of the following detailed description, in conjunction with the drawings.

BRIEF DESCRIPTION OF THE DRAWINGS

The embodiments set forth in the drawings are illustrative and exemplary in nature and not intended to limit the inventions defined by the claims. The following detailed description of the illustrative embodiments can be understood when read in conjunction with the following drawings, where like structure is indicated with like reference numerals and in which:

DETAILED DESCRIPTION

The figures depict embodiments of vehicle consoles and display buttons. The vehicle consoles generally comprise a display housing disposed within the vehicle console. The display housing comprises a plurality of display buttons having an indicator component for visual reference by a passenger. A light source is disposed inside the vehicle console and is operable to emit light through the indicator component on the display button. An etched lens is disposed between the light source and the indicator component (or integral with the indicator component) to diffract light such that the light emitted from the indicator component diverges so that passengers can see the illuminated indicator component at a wider viewing angle. The vehicle console and display buttons having etched lenses will be discussed in more detail herein.

Figure 1:
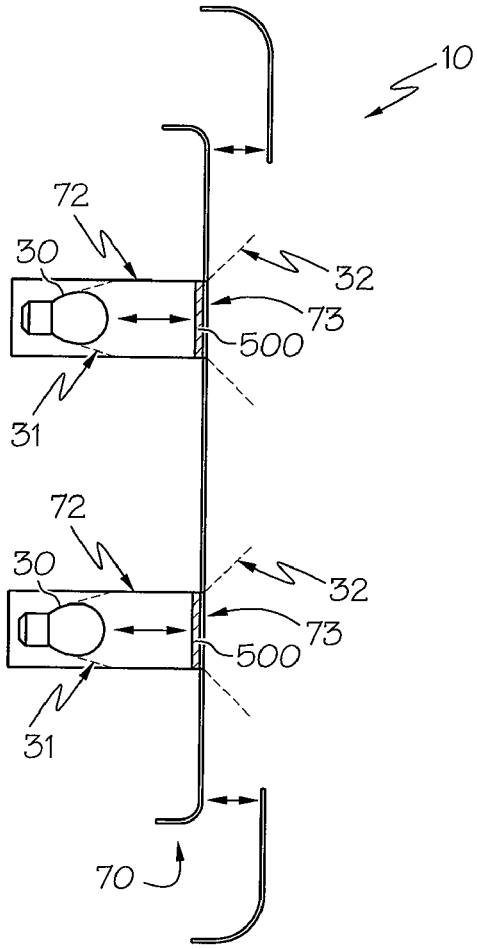
FIG. 1 is a schematic view depicting a vehicle console comprising display buttons with etched lenses according to one or more embodiments shown and described herein.
Figure 2:
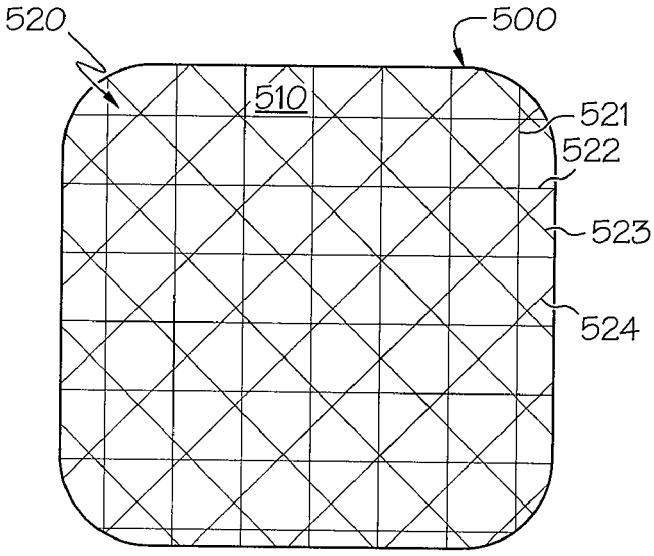
FIG. 2 is a schematic view depicting a patterned outer surface of an etched lens according to one or more embodiments shown and described herein.
Figure 3:
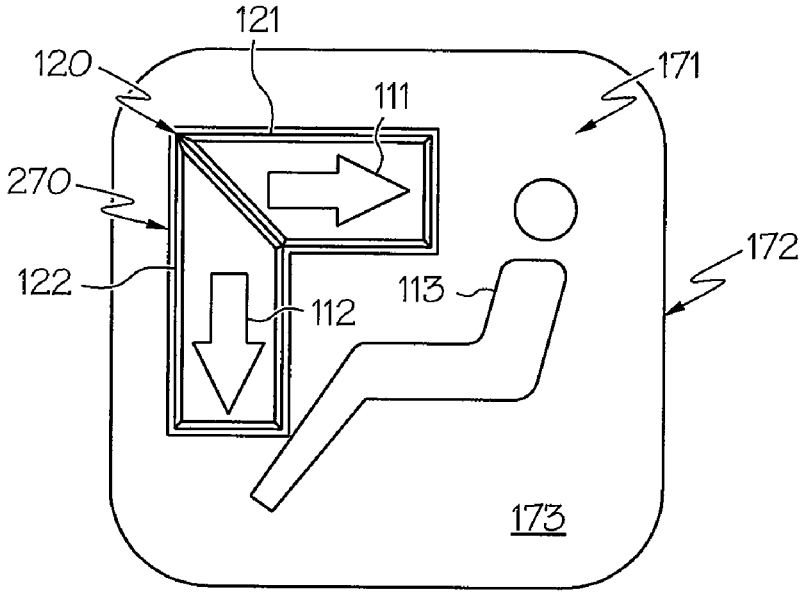
FIG. 3 is a front view depicting an alternative embodiment of a display button and indicator components according to one or more embodiments shown and described herein.
Figure 4:
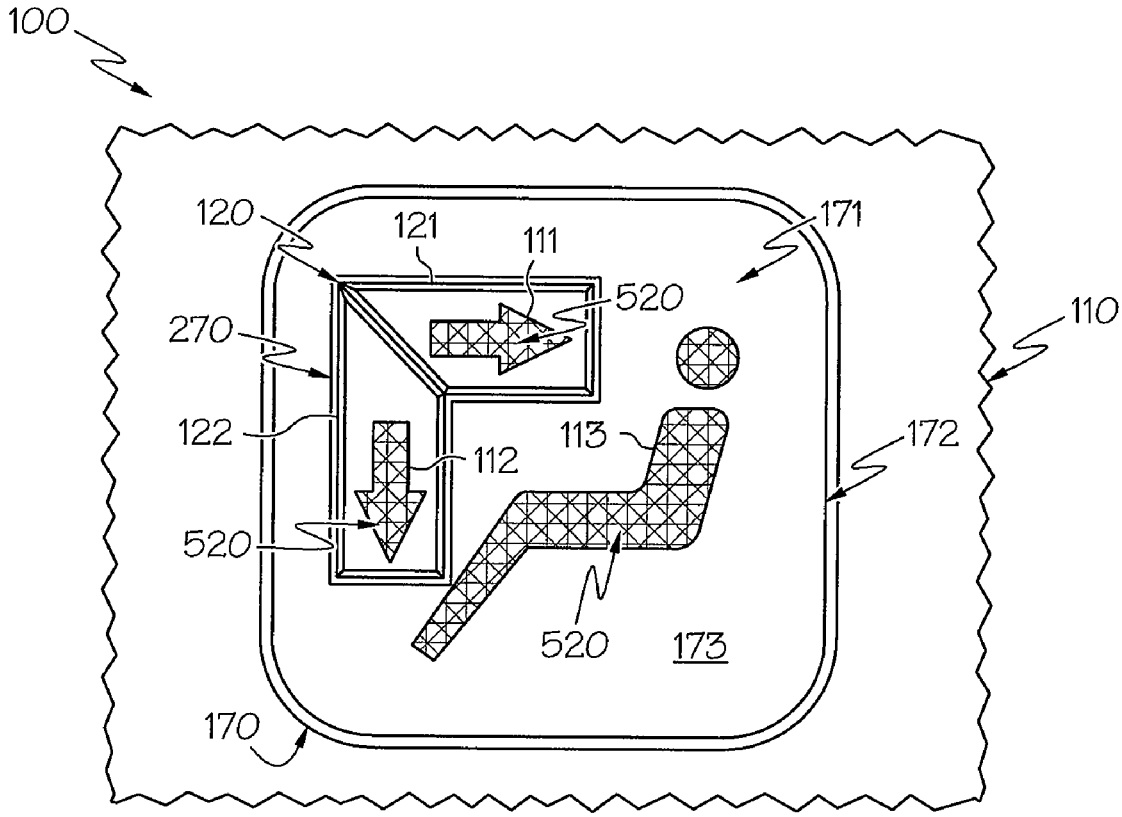
FIG. 4 depicts a front cutaway view of a vehicle console with the display button of FIG. 3 showing an etched lens through indicator lens according to one or more embodiments shown and described herein.
Figure 5:
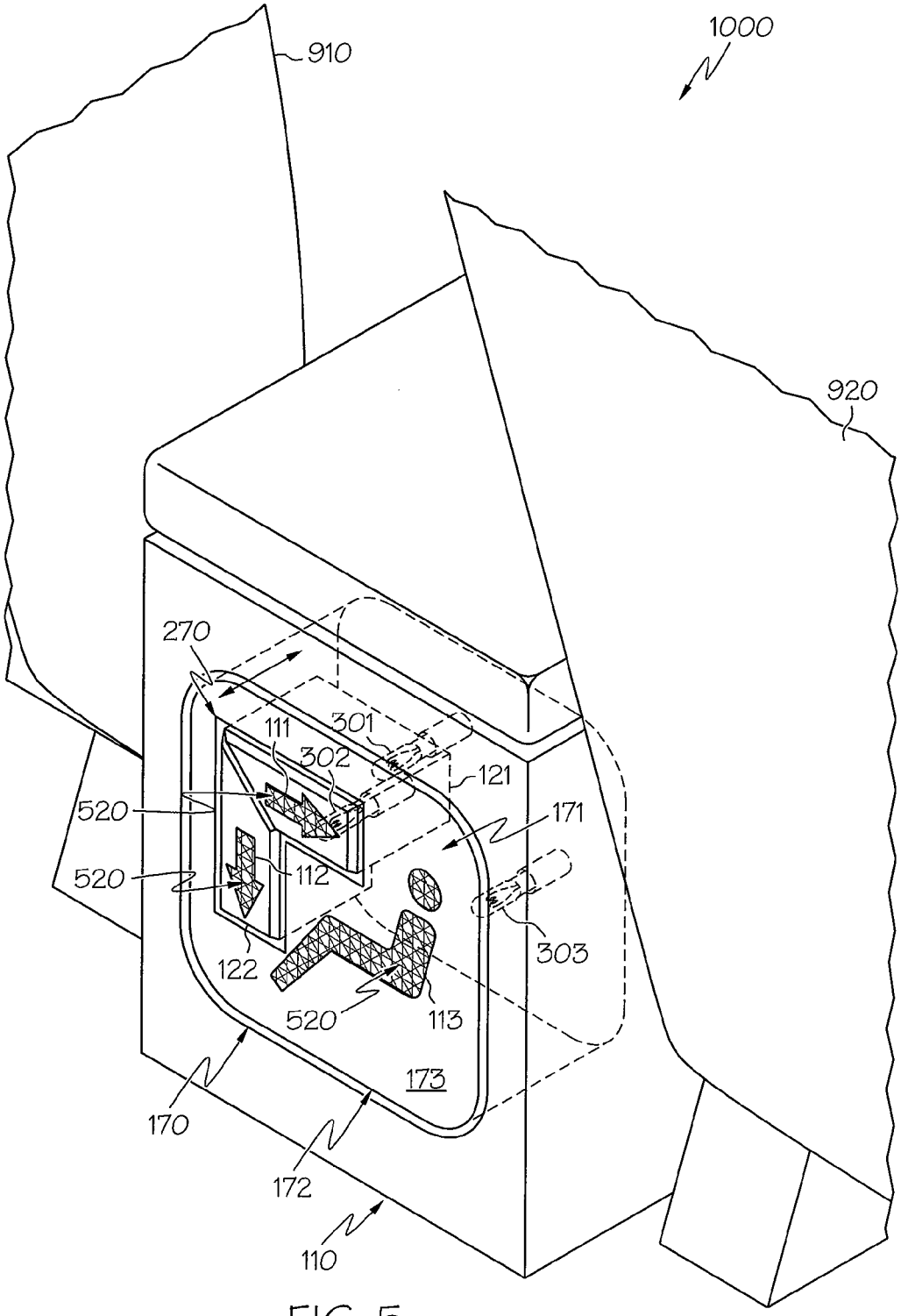
FIG. 5 depicts a perspective view of a rear vehicle console according to one or more embodiments shown and described herein.

Referring now to FIGS. 1 and 2, a vehicle console assembly (shown in cross section) may include a vehicle console panel, a display housing 70 disposed within an opening of the vehicle console, the housing having a plurality of display buttons 72. It will be understood, however, that while a housing with a plurality of display buttons integrated therein may be set into a vehicle console, similarly, a single display button may be placed into any opening within the console, or otherwise associated with a vehicle console opening. In addition, the display buttons may be substantially flush with the console (as illustrated in FIG. 1), or may comprise functional actuators (as illustrated in FIGS. 3-5).

As illustrated, the display buttons 72 comprise an etched lens 500. The etched lens 500 may comprise etchings 520 on an outer surface 510. The outer surface 510 may be the surface of the etched lens 500 facing the interior of a vehicle passenger space and being opposite the light source 30. Etchings 520 may extend any depth into the etched lens 500 such that light passed through the etched lens 500 is diffracted. Etchings 520 may comprise any number of lines, patterns, geometries, figures, or designs. In one embodiment, as seen in FIGS. 2 and 4, etchings 520 on the etched lens 500 may comprise etched lines in a substantially crisscrossed pattern. For example, a first series of etched lines 521 may be in a substantially vertical direction defined as the north-south direction. A second series of etched lines 522 may be in a substantially horizontal direction, defined as the east-west direction, and be substantially perpendicular with the first series of etched lines 521. A third series of etched lines 523 may be in a substantially northwest-southeast direction. And, a fourth series of etched lines 524 may be in a substantially northeast-southwest direction and be substantially perpendicular with the third series of etched lines 523. In the alternative, the etchings 520 may comprise more or fewer series of lines that may or may not be symmetrical. Furthermore, the distance between etchings 520 may vary depending on the light diffraction desired. In one embodiment, etchings 520 may comprise a series of concentric circles growing in diameter. In another embodiment, the etchings 520 may comprise a plurality of dots or solid circles disposed about the outer surface 510 of the etched lens 500.

Etchings 520 may be disposed about the entire outer surface 510 of the etched lens 500 or, in the alternative, etchings 520 may be disposed only about those parts of the etched lens that will be proximate indicator components as will become apparent later herein. In one embodiment, etchings 520 may comprise laser etchings formed by a laser passing over the outer surface 510 of the etched lens 500. In another embodiment, etchings 520 may be formed through mechanical etching, chemical etching, or any other available process operable to produce etchings 520 for diffracting light.

Still referring to FIGS. 1 and 2, the display buttons 72 having the etched lens 500 may be disposed within a housing of a vehicle console 10. In one embodiment, as seen in FIG. 1, the etched lens 500 may be disposed inside a button housing of the display buttons 72 which themselves may be disposed inside the display housing 70. Particularly, as illustrated, the display button 72 may comprise an indicator lens 73 having one or more indicator components (e.g., 171 in FIGS. 3-5) and an etched lens 500 between the indicator lens 73 and a light source 30. However, it should be understood that the etched lens 500 may be directly incorporated into display buttons 72 as illustrated, or fused with the indicator lens 73 such that the indicator lens itself has etchings.

Etched lens 500 may be secured through screws, adhesives, fasteners, snaps, or any other alternative connection capable of fixedly or removably securing the etched lens 500. Where the etched lens 500 is disposed within the display buttons 72, the etched lens 500 may abut the indicator lens 73 about the outer surface as seen in FIG. 1. In another embodiment, a gap may separate the etched lens 500 from the indicator lens 73. In yet another embodiment, the etched lens 500 may be etched so that the etched lens 500 comprises the indicator lens 73. It will also be understood that the etched lens 500 may alternatively be disposed anywhere about the vehicle, including any vehicle console, door panel, headliner, etc. such that light from a light source is diffracted by the etched lens either before (or as) it passes through a function indicator.

The vehicle console may be any compartment, panel, wall, display, seat, or other vehicle part that may contain informational read-outs, buttons, warnings or any alternative type of display. For example, referring to FIGS. 3-5, a vehicle interior (1000) may comprise a rear console 110 between the driver's seat 910 and the front passenger seat 920. The rear console 110 may comprise heating, ventilation and air conditioning (HVAC) controls for passengers in the rear of the vehicle. The display housing 170 may be disposed within the rear console 110 and comprise a display button 172 having one or more indicator components 171. In one embodiment the display button may be actuated within the rear console 110 such that it may be flush with the rear vehicle console 110. In another embodiment, the display button may comprise a panel, knob or any other alternative structure within a display housing 170 which is located within the rear vehicle console 110.

Still referring to FIGS. 3-5, the display button 172 may comprise an outer indicator lens 173 having indicator components 171, with an etched lens behind the indicator lens 173 (FIGS. 4-5 illustrate the etched lens behind the indicator lens). Indicator components 171 may comprise text, numerals, figures, symbols, lines, reference characters or any combination thereof that may become illuminated by light sources 301,302,303 and relate to a function of the vehicle. In one embodiment, as seen in FIGS. 3-5, indicator components 171 may comprise an upper body arrow 111, a lower body arrow 112 and a body 113 for use in HVAC controls. For example, the upper body arrow 111 and lower body arrow 112 may aid a passenger in identifying the output location of cooled or heated air with respect to their body position (displayed as the body 113). In another embodiment, the indicator components 171 may comprise a control meter for indicating the temperature or flow level of the HVAC. In yet another embodiment, the indicator components 171 may comprise a volume control readout for a television or stereo system. The indicator lens 173 may comprise glass, plastic, or any other material operable to emit light from a light source as will be discussed later herein. In one embodiment, the indicator lens 173 may comprise a clear plastic material with its outer surface painted such that the clear plastic surface is only present about the indicator components 171. Etchings 520 on the etched lens 500 may be disposed proximate the indicator lens 173 such that light is diffracted at least proximate to the indicator components 171. In one embodiment, the etched lens may itself comprise the indicator components such that the outer surface of the indicator lens comprise etchings. It should be appreciated that while the indicator components have been described herein with respect to a few individual exemplary embodiments (such as an HVAC control), indicator components and display buttons may be adapted for any other function throughout the vehicle.

As seen in FIGS. 3-5, the display button 172 (which can be substantially flush with console) can have raised display buttons, or indicator buttons 120, that can be actuated into and out from the display button housing 270. The indicator buttons 120 may themselves comprise indicator components 171. For example, as depicted in FIGS. 3-5, indicator buttons 120 may comprise an upper body button 121 with an upper body arrow 111 and a lower body button 122 with a lower body arrow 112 disposed within a display button housing 270. In such an embodiment, a passenger may selectively actuate a display button 120 depending on the desired output location of cooled or heated air. The indicator components 117 may thereby selectively illuminate depending on the positional state of the indicator buttons 120. In another embodiment, a knob or wheel (not shown) may be adjacent an indicator component 117 about the display button 172. For example, an indicator component 117 may comprise a control meter (not shown) for displaying the level of air flow and may be disposed about the circumference of a knob. As the knob is turned, the control meter may selectively illuminate to display the corresponding level of air flow. In another embodiment, any alternative component such as a switch, toggle or any other suitable vehicle actuation switch may be disposed about, or be in communication with, the display housing or vehicle console.

Referring to the schematic in FIG. 1, a light source 30 may be disposed inside the vehicle console 10 and may be operable to emit light through button housing toward indicator lens 73 associated with the display button 72. The light source 30 may comprise an incandescent lamp, a compact fluorescent lamp, a laser emitting diode (LED), or any other source operable to emit light, or any combination thereof. The light source 30 may comprise a single lamp or LED or a plurality of lamps or LEDs. Furthermore, the light source 30 may be operable to emit a colored light or, in the alternative, may be disposed proximate a colored film or pathway such that the light from the light source 30 becomes substantially limited to a certain color wavelength. For example, in one embodiment, the indicator lens 73 may comprise a red translucent material such that light from the light source emitted through the vehicle indicators appear red. In another embodiment, a plurality of LEDs operable to emit different colored light may comprise the light source 30. In such an embodiment, each LED may selectively be activated such that only the LEDs operable to emit the desired color light are activated. The light source 30 may be mounted inside the vehicle console 10 by screws, fasteners, adhesives or any other type of connection capable of fixedly or removably securing the light source 30. As seen in FIG. 5, multiple light sources 301,302,303 may be disposed about respective indicator components 111,112,113 and may be secured to the back of indicator buttons 120 or the back of the display housing as shown. Furthermore, light sources 301,302 disposed within display buttons 120 may be in communication with the indicator buttons 120 (or alternative components discussed above) such that the light sources 301,302 emit light based at least in part on the selective position of the indicator buttons 120.

Referring to FIGS. 1 and 2, the light emitted from the light source 30 may initially have a first pathway 31 before it reaches the etched lens 500. Particularly, the etchings 520 on the etched lens 500 may diffract the light into a plurality of diverging secondary pathways 32 such that the light emitted from the indicator lens 73 (or 173) is diverging. For example, as shown in FIG. 1, the light source 30 may be operable to emit a light with a relatively narrow first pathway 31. As the light passes through the etched lens 500, the etchings 520 diffract the light into new secondary pathways 32 that are diverging with respect to the first pathway 31. Where the display button is a display button located in a rear console as shown in FIGS. 3-5, passengers may occupy a plurality of positions (e.g., behind the driver's seat, in the middle, or behind the passenger's seat) about the rear console 110. The etched lens 500 may diverge the light such that it may be seen from each of the plurality of passenger positions. Depending on the position of the display button and the positions of the passengers that may wish to view the display button, the orientation and pattern of the etchings 520 may further influence the viewing angle of the display button. For example, where substantially horizontal etchings may diffract light in vertical directions (and substantially vertical etchings may diffract light in horizontal directions), etchings may only comprise a substantially vertical pattern where horizontal diffraction is the only concern. Alternative arrangements of etchings 520 may further be selected to match the environment of the display button.

It should now be understood that display buttons as described herein may be used in a vehicle to diffract and diverge light from a light source. Diffracting light with the etched lens may thereby enable vehicle passengers to effectively view an indicator component within a display button from a greater variety of positions. This may be especially advantageous for indicator components in rear consoles. Unlike front consoles which are typically disposed at a steering wheel level near the line of sight for a driver or front passenger, rear consoles and indicator components therein are typically disposed at a middle or lower torso level of the rear passenger. As a result, display buttons and vehicles consoles incorporating the same which utilize an etched lens to facilitate viewing of the indicator components may be especially useful for rear consoles.

For the purposes of describing and defining the present invention it is noted that the terms "substantially" and "about" are utilized herein to represent the inherent degree of uncertainty that may be attributed to any quantitative comparison, value, measurement, or other representation. These terms are also utilized herein to represent the degree by which a quantitative representation may vary from a stated reference without resulting in a change in the basic function of the subject matter at issue.

While particular embodiments and aspects of the present invention have been illustrated and described herein, various other changes and modifications can be made without departing from the spirit and scope of the invention. Moreover, although various inventive aspects have been described herein, such aspects need not be utilized in combination. It is therefore intended that the appended claims cover all such changes and modifications that are within the scope of this invention.

What is claimed is:

1. A vehicle console, comprising:

a display button disposed within a housing of the vehicle console, the display button comprising an indicator component;

a light source disposed within the vehicle console, and operable to emit light through the display button; and at least one etched lens associated with the vehicle display button operable to diffract light provided by the light source such that the light emitted from the indicator component diverges from a first pathway to a second pathway;

wherein the etched lens comprises etched lines in a substantially crisscrossed pattern.

2. The vehicle console of claim 1 wherein the etched lens diffracts light such that the light diverges from the first pathway into multiple secondary pathways.

3. The vehicle console of claim 1 wherein a single etched lens diverges light for a plurality of indicator components.

4. The vehicle console of claim 1 further comprising an indicator lens.

5. The vehicle console of claim 4, wherein the etched lens is disposed between the indicator lens and the light source.

6. The vehicle console of claim 4, wherein the indicator lens and the etched lens are integral.

7. A display button for a vehicle console comprising:

a housing for directing transmittance of light from a light source;

an indicator lens having an indicator component identifying vehicle functionality; and an etched lens comprising an etched pattern, at least a portion of the etched lens being disposed within the display housing between the light source and the indicator lens, wherein the etched lens is operable to diffract light provided by the light source such that the light emitted from the indicator component diverges from a first pathway within the housing into multiple secondary pathways outside of the display button;

wherein the etched lens comprises etched lines.

8. The display button of claim 7 wherein the etched lines comprise a substantially crisscrossed pattern.

9. The display button of claim 7 wherein a single etched lens diverges light for a plurality of indicator components.

10. The display button of claim 7, wherein the indicator lens and the etched lens are integral.

* * * * *